United States Patent [19]

Leloux

[11] 4,055,098

[45] Oct. 25, 1977

[54] MANUFACTURING CORRUGATED PERFORATED PLASTIC TUBES

[75] Inventor: Arnoldus Willem Jan Leloux, Dedemsvaart, Netherlands

[73] Assignee: Wavin B.V., Netherlands

[21] Appl. No.: 635,175

[22] Filed: Nov. 25, 1975

Related U.S. Application Data

[62] Division of Ser. No. 487,201, July 10, 1974, Pat. No. 3,965,782.

[30] Foreign Application Priority Data

July 16, 1973 Netherlands ..... 7309844

[51] Int. Cl.[2] ..... B26F 1/18

[52] U.S. Cl. ..... 83/309; 83/54; 83/444; 83/660

[58] Field of Search ..... 83/54, 309, 513, 193, 83/660, 689, 192, 194, 444

[56] References Cited

U.S. PATENT DOCUMENTS

| | | | |
|---|---|---|---|
| 3,620,115 | 11/1971 | Zieg et al. | 83/54 X |
| 3,759,123 | 9/1973 | Van Zon | 83/54 |
| 3,824,886 | 7/1974 | Hegler | 83/54 X |
| 3,831,470 | 8/1974 | Maroschak | 83/54 X |
| 3,901,113 | 8/1975 | Oltmanns | 83/54 X |
| 3,910,713 | 10/1975 | Maroschak | 83/54 X |

*Primary Examiner*—Frank T. Yost

*Attorney, Agent, or Firm*—Irving M. Weiner; Pamela S. Austin

[57] ABSTRACT

A device for manufacturing corrugated plastic tube by subjecting an internally unsupported corrugated plastic tube, at a temperature between 30° and 70° C, to the simultaneous action of at least two punching members in one or in two corrugations.

A device comprising a guide for corrugated plastic tube, and punching means with an operating member for simultaneously acting upon at least two punching members spaced a short distance from each other.

5 Claims, 4 Drawing Figures

MANUFACTURING CORRUGATED PERFORATED PLASTIC TUBES

This is a division of application Ser. No. 487,201, filed July 10, 1974, now issued U.S. Pat. No. 3,965,782.

DISCUSSION OF THE PRIOR ART

The present invention relates to a device for manufacturing perforated corrugated plastic tube by causing punching means to act upon a plastic tube which is preferably unsupported on its inner side and which is protected from considerable deformation in the effective punching area.

BACKGROUND OF THE INVENTION

Methods for manufacturing corrugated perforated plastic tubes, particularly corrugated plastic tube made of a thermoplastic and particularly suited for drainage pipe, are known per se.

According to one of the known methods, a corrugated plastic tube which is corrugated in the transverse direction is externally supported by a sleeve-shaped guide, while cutters from the outer side of the plastic tube are active in the area in which the tube is externally supported, or outside this areawhere the tube is sufficiently rigid to stand the action of the punching means.

According to another known method, in punching helically profiled corrugated plastic tube, the sleeve-shaped guide is identically profiled as the plastic tube, so that when the sleeve-shaped guide is turning, the tube is simultaneously supported and conveyed.

Although these methods are satisfactory in many cases, the operative rate, i.e., the rate at which perforations can be made, is often not fast enough. With methods one cannot work too fast because either the cutters in the shape of stamping knives form rough holes in the plastic tube, or, when a heated tube is used, no holes at all are made, becauase the tube of thermoplastic material is resilient along with the stamping knives so that no punching effect is produced.

SUMMARY OF THE INVENTION

The present invention provides to provide a method for manufacturing corrugated perforated plastic tube by causing punching means to act upon a tube which is at least partially externally, but not at all internally, supported in the effective punching area, while perforations are provided at a fast rate in the corrugated plastic tube, particularly in the bottom of the corrugations.

This is attained by the arrangement that the plastic tube is subjected to the simultaneous action of at least two punching members in one or in two corrugations which are situated at a short distance with respect to one another.

Preferably the two punching members are active in the corrugation bottom or in two consecutive ones, while at that location the tube is surrounded by a supporting ring which is situated at a short distance from the corrugated tube.

The two punching members are efficiently active in a plane which is substantially perpendicular to the longitudinal axis of the plastic tube, or are symmetrical with respect to such a plane.

It has been found that in case of a simultaneous action of two punching members as described hereinbefore good results are obtained, which arises from the following facts:

1. since the punching means are simultaneously applied to the tube at two locations the resistance against indentation is considerably increased and as a consequence, the desired opening or perforation is made faster;

2. the punching operation is performed at a faster rate because the two innermost points of the cutters are the first to begin, whereupon the sides start acting, and finally the two outer points. The force exerted on the tube by each punching member thus less than the force exerted in the known methods.

According to a preferred embodiment, the temperature of the plastic tube is maintained at a value above 30° C during the action of the punching members. It has been found that when the known methods are performed in a tube having too low a temperature, the punching members form less decorative perforation edges, which could be remedied by using a tube maintained at a higher temperature. When a punching member acts upon such a tube the wall thereof frequently acts resiliently along with the punching member, so that no desired perforation is made during the punching operation. It has been found that this difficulty can be completely alleviated when two punching members act simultaneously upon a heated tube.

In case of grooved, plastic tube with helical grooves the two punching members act upon the plastic material in two consecutive grooves.

The invention in another aspect relates to a device for manufacturing corrugated perforated plastic tube, comprising at least guide means for supporting a corrugated plastic tube, punching members disposed on the outerside of the tube to act upon the plastic tube, an operating means for activating a punching member, means preventing the deformation of the tube, and conveying means for conveying the corrugated plastic tube.

A somewhat similar device, consisting of a sleeve or a cylindrical support of oblong interconnected strips or narrow rings, to which a springloaded punching member in the shape of a cutter is secured, and a circular ring with a cam which moves the upper part of the punching member inwardly and which serves as an operating member, is known per se from U.S. Pat. No. 3,759,123.

The working rate of such a device is, however, too low.

According to the present invention, the device is characterised in that the operating means for the punching members can simultaneously act upon at least two punching members which are situated at a rather short distance from one another.

The punching members are preferably symmetrical with respect to, or in a plane which is substantially perpendicular to, the axis of the guide for the corrugated plastic tube.

DETAILED DESCRIPTION

Figure 1:
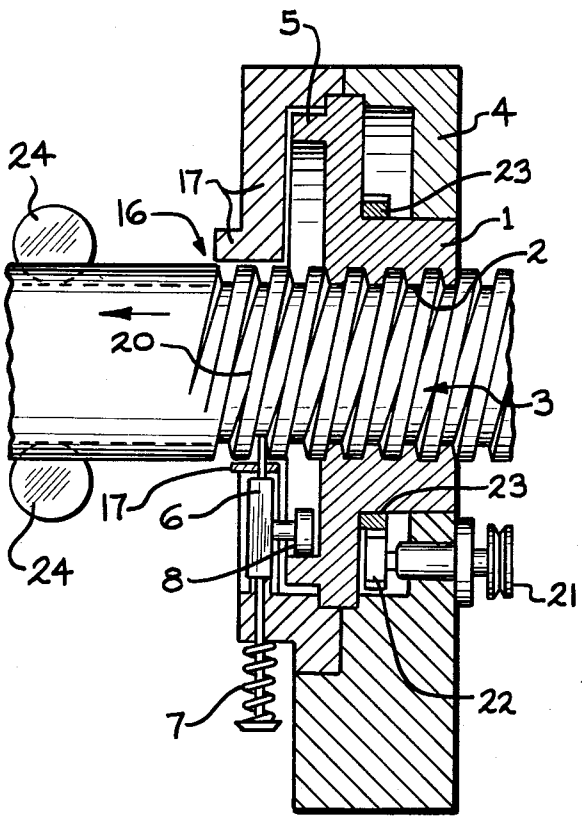
FIG. 1 is a section through a device according to the invention.

In FIG. 1 there is represented a device for manufacturing a corrugated plastics tube by punching.

Figure 4:
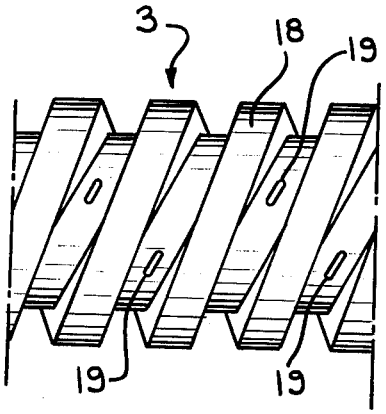
FIG. 4 represents a corrugated plastic tube with helically extending grooves which is provided with punched perforations performed by the method according to the invention.

This device comprises a guide member for plastic tube in the shape of a sleeve 1 which has an internal helically extending sectional form 2. When a corrugated tube 3 with a helically extending sectional form 18 (FIG. 4) is punched, the inside of the sleeve or box 1 has the same profile as the outside of the plastic tube 3. Due to cooperation between the corrugation of the plastic tube 3 with the section 2 on the inside of the sleeve 1, the plastic tube 3 with its helically extending profile will be conveyed when the sleeve 1 rotates. The sleeve 1 serves therefore as a guide member and a conveying member. A gear arrangement 22 and 23 driven by drive 21 is used for rotating the sleeve 1.

The temperature of the plastic tube 3 is maintained, e.g., when polyvinylchloride is punched, at a value ranging from 30° to 90° C but it will be obvious that different plastics may require different temperatures. At any rate the temperature should be below the softening temperature range of the plastic, since above that temperature there is evidently no question of performing punching operations on account of the resilience of the plastic material. The tube is preferably maintained at a temperature ranging from 50° to 70° C.

Around the sleeve 1 there is mounted a stationary ring 4 carrying cutters 6 and a holding means 12 for the cutters 6. The cutters are retained in their non-operative position by means of a spring 7. The cutters 6 are constructed as oblong steel strips which are resiliently secured at at least one end thereof. It is recommended to use resilient steel strips. When the sleeve 1 rotates then a non-circular ring 5, which is secured to this sleeve 1, will downwardly press and operate member 8 of the cutter 6 in order to punch the desired perforation into the plastic tube.

According to the invention the device comprises two strip-shaped cutters **6*a* and 6*b* which are active on either side of a symmetry plane 20 which is substantially perpendicular to the axis of the sleeve 1, the cutters 6*a* and 6*b* being simultaneously activated by the ring 5 which acts upon the same operating member 8 for the two cutters 6*a* and 6*b*. As a consequence the two cutters 6*a* and 6*b* are simultaneously pressed towards the interior of the plastics tube so as to form the desired perforation. This is effected in spite of the rather high temperature of the plastic tube, whereby a certain resilience of the synthetic material counteracts the punching effect of the cutters, 6*a* and 6*b*.**

In order to obtain the desired number of perforations, three pairs of cutters are disposed on the circumference of the rotating sleeve 1, while each pair of cutters **6*a* and 6*b*** is simultaneously pressed inwardly by means of a cam.

Figure 2:
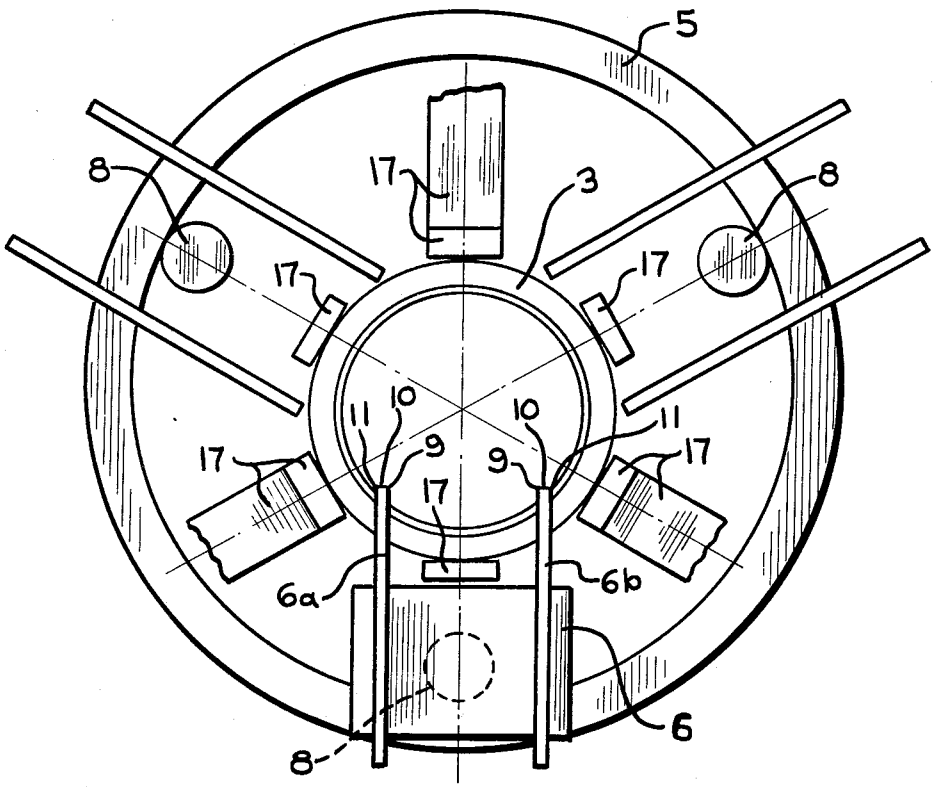
FIG. 2 shows in outline a part of a device according to FIG. 1 depicted in the operative position.

The desired faster punching rate results from the fact that first the innermost points 9 of the cutters act upon the plastic tube 3 (see FIG. 2), thereupon the sides 10 act on the tube and finally the outermost parts 11 of the cutters, which are either bevelled or not, act on the tube, whereby excellent perforations 19 are obtained.

The two cutters **6*a* and 6*b* which are simultaneously activated are disposed in such a way that, when the sleeve has an inner helical profile whether with double helix or not, they can act upon the synthetic material of two consecutive corrugations in a plastic tube. It has been found that in a helically profiled corrugated plastic tube excellent results can thus be obtained in spite of the fact that the cutters are not active in one plane, but at a very small distance from each other on either side of a symmetry plane. This symmetry plane 20 is then perpendicular to the plastic tube which should be perforated. The cutters are arranged so as to point in the direction of the profile 18 (see FIG. 4**).

FIG. 1 shows that the cutters are active on the plastic tube 3 in the area or region in which the tube is surrounded by the annular passage 16 of the ring 4. The diameter of this passage is greater than the outside diameter of the tube to be treated. During the action of the cutters, the plastic tube is slightly deformed so that the same is pressed against the wall of the passage. This, however, does not interfere with the action of the device. For further support a guide consisting of oblong strips 17 can be used which are disposed at several locations.

When a perforating treatment is performed on the plastic tube it can always move through the ring 4, in spite of the minor deformation produced during the action of the cutters.

Figure 3:
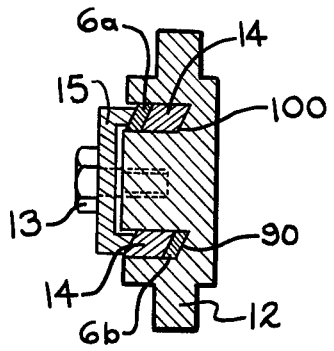
FIG. 3 is a detail of the securing of the punching members.

The cutters are secured by means of a clamp 15 (FIG. 3) in a cutter holder 12. The remainder of each cutter is resiliently movable to permit the tube to move along when the cutters **6*a* and 6*b* penetrate into the plastic tube. Recesses 90 and 100 are provided in the cutter holder 12 in order to enable the cutters 6 to be disposed parallel to the pitch of the profile, and the cutters 6*a* and 6*b* can be staggered with respect to each other by means of filling pieces 14. A screw 13 is used for securing the clamp 15 to the holder 12.**

Although in the FIG. 1 the sleeve 1 is shown with an inner helical profile, the sleeve 1 may have a smooth inner wall when the grooved tube has transverse corrugations. The corrugated tube may then be conveyed by means of rollers 24 represented in dotted lines. As shown the ends of the cutters **6*a* and 6*b*** make an angle of about 60° with the longitudinal axis.

1. A device for forming perforations in a corrugated plastic tube, comprising:

guide means for supporting said corrugated plastic tube;

a plurality of punching members, at least two of said punching members being substantially parallel and spaced in close proximity to each other;

operating means for activating said punching members;

means for preventing deformation of said tube;

conveying means for conveying said tube to be perforated;

said operating means simultaneously activating said at least two substantially parallel spaced punching members; and said at least two substantially parallel spaced punching members being disposed in a plane which is oriented substantially transverse to the longitudinal axis of said conveying means.

2. A device according to claim 1, wherein:

said punching members are disposed in a plane which is oriented substantially perpendicular to the longitudinal axis of said conveying means.

3. A device according to claim 2, wherein:

said punching members are disposed symmetrical with respect to the longitudinal axis of said conveying means.

4. A device according to claim 1, wherein:

said punching members are strip-shaped; and said strip-shaped punching members are secured at one end in a manner which permits said punching members to move along with a conveyed tube.

5. A device according to claim 1, wherein:

said at least two substantially parallel spaced punching members are disposed so as to point substantially in the same direction.

* * * * *